US008317145B2

(12) United States Patent
Reed

(10) Patent No.: US 8,317,145 B2
(45) Date of Patent: Nov. 27, 2012

(54) SPRING LOADED CAMMING DEVICE WITH MOVABLY-ANCHORED TRIGGER

(76) Inventor: Max William Reed, Niwot, CO (US)

( * ) Notice: Subject to any disclaimer, the term of this patent is extended or adjusted under 35 U.S.C. 154(b) by 39 days.

(21) Appl. No.: 12/762,334

(22) Filed: Apr. 17, 2010

(65) Prior Publication Data

US 2010/0263478 A1 Oct. 21, 2010

Related U.S. Application Data

(60) Provisional application No. 61/170,240, filed on Apr. 17, 2009.

(51) Int. Cl.
*A47F 5/08* (2006.01)

(52) U.S. Cl. ..... 248/231.9; 248/925; 428/37

(58) Field of Classification Search ..... 248/231.9, 248/925, 694; 294/95, 94, 28; 428/37
See application file for complete search history.

(56) References Cited

U.S. PATENT DOCUMENTS

| | | | | |
|---|---|---|---|---|
| 4,923,160 | A * | 5/1990 | Waggoner | 248/200 |
| 6,679,466 | B2 * | 1/2004 | Brown | 248/231.9 |
| 6,736,359 | B2 * | 5/2004 | Murray | 248/231.9 |
| 7,040,588 | B2 * | 5/2006 | Lowe | 248/231.9 |
| 7,959,119 | B2 * | 6/2011 | Tusting et al. | 248/231.9 |
| 2004/0035992 | A1 * | 2/2004 | Watts | 248/231.9 |
| 2005/0218282 | A1 * | 10/2005 | Phillips | 248/231.9 |

* cited by examiner

*Primary Examiner* — Amy J. Sterling

(57) ABSTRACT

A spring loaded camming device and a trigger mechanism therefor. The trigger mechanism may include an axle, an inner and outer cam, a flexible stem, a trigger handle, and a trigger wire passing through the trigger wire and coupling in an efficient and effective manner, the inner and outer cams to each other and to the trigger handle. A bias member may be associated with the trigger wire, particularly in asymmetric type camming devices. Various embodiments are disclosed.

22 Claims, 5 Drawing Sheets

SPRING LOADED CAMMING DEVICE WITH MOVABLY-ANCHORED TRIGGER

CROSS REFERENCE TO RELATED APPLICATIONS

This application claims the benefit of U.S. Provisional Application No. 61/170,240, filed Apr. 17, 2009, entitled Camming Device With Resilient Movably-Anchored Trigger and having same inventor as above.

FIELD OF THE INVENTION

The present invention relates to trigger action in a spring loaded camming device of the type used in rock and mountain climbing. The present invention is applicable to symmetric and asymmetric camming devices.

BACKGROUND OF THE INVENTION

A variety of climbing aids are known in the art and they include spring loaded camming devices. Spring loaded camming devices are discussed in U.S. Pat. No. 4,184,657, issued to Jardine; U.S. Pat. No. 4,643,377, issued to Christianson; and U.S. Pat. No. 5,860,629 issued to Reed (the inventor herein). These devices are typically classified as symmetric or asymmetric. In a symmetric device, the head of the cam is substantially centered about the stem to which a climbing rope is attached, while in an asymmetric device, the head of the cam is not centered about the stem, but rather offset therefrom. These aids may be inserted in "cracks" and crevices during a climb and the provision of symmetric and asymmetric devices provides a climber with a wider selection of climbing aids depending on the geometry of the rock feature and the expected position of the rope. U.S. Pat. No. 4,184,657 discloses a symmetric camming device and U.S. Pat. No. 5,860,629 discloses an asymmetric camming device.

Conventional symmetric and asymmetric camming devices may include cams that are pivotally connected to the head and are biased for outward movement. From each cam, a trigger wire extends to a swaged coupling where it is fastened to a trigger cable. The trigger cable in turn connects to a trigger handle that is mounted for movement along the stem. In use, a climber pulls the trigger handle down the stem which in turn pulls through the trigger cables, swaged couplings, and trigger wires to retract the cams. The device is then positioned in a crack or crevice and the user releases the trigger handle permitting the cams to extend outward and engage the rock. This action may be repeated a few times in an attempt to achieve secure placement in the crack.

In a conventional spring loaded camming device, there are typically four cams arranged in two cam pairs. Each cam pair has a five part trigger linkage that includes two trigger wires, two swaged couplings and a common trigger cable. Thus, in a conventional camming device, the trigger mechanism includes 10 pieces and a trigger plate or handle.

While trigger systems of this type have been used for many years, they have disadvantageous aspects that include the following. Firstly, the trigger system is expensive. It has many parts and they are carefully assembled by hand, which is one of the most difficult and time consuming tasks associated with manufacturing. Secondly, each part may have a given variance in size, shape or other quality and the cumulative variations are problematic to the manufacturing process and the quality of the finished product. Thirdly, the devices are fairly fragile and the trigger cables are long and unprotected. The cable easily tangled with other gear. In addition, the cables wear out due to being repeatedly flexed and twisted. Fourthly, where the trigger cables pass through the trigger must be centered precisely during manufacturing to balance the initial orientation of the cam head relative to the trigger. The cables are typically glued there to prevent them from moving. This is both cost and time consuming, and misalignment results in a defective product.

A need exists for a camming device with a trigger mechanism that has fewer components and one with a simpler, more durable design.

Another problem associated with spring loaded camming devices relates to their stability in a crack, or the lack thereof. For a camming device to be reliable, it must be stable and retain its holding power, even if the camming device moves slightly in the crack after it is initially placed.

There are two main causes of cam movement. The first is associated with forces exerted by a climbing rope on the stem as the rope moves from side to side or front to back (normal motion during climbing). Movement of the stem can be transferred to the cams causing them to reposition themselves or "walk" in a crack. A need exists to provide a camming device in which the transfer of force from the stem to the cams is reduced.

Another cause of cam movement that is more often experienced in asymmetric camming devices is an occurrence referred to as "tipping out." It is a common practice among climbers to adjust the position of the cams by pushing from the stem. In a symmetric camming device, the "pushing force" is more equally distributed since the head is aligned with the stem. In an asymmetric camming device, however, the head is not centered and one cam may move more than the other causing de facto rotation of the device about the distal end of the lesser moving or inner cam. If the inner cam rotates too far, it may move past its' "toothed" surface and may slip, resulting in a failure of the device to hold in the crack. Tipping out in an asymmetric camming device may also occur from "normal" rope motion. A need exists to improve an asymmetric camming device such that the incidence of tipping out is greatly reduced or eliminated.

SUMMARY OF THE INVENTION

Accordingly, it is an object of the present invention to provide a spring loaded camming device that overcomes shortcomings of the prior art, while also improving aesthetics and ease of use.

It is another object of the present invention to provide a spring loaded camming device with a reduced number of components in the trigger linkage and trigger mechanism.

It is also an object of the present invention to provide a spring loaded camming device that reduces the incidence of tipping out in an asymmetric camming device.

In one embodiment, the present invention may include an axle, a first cam, a second cam, a flexible stem, a trigger handle configured for movement relative to the stem and having a trigger wire retention form, and a continuous trigger wire coupled from the first cam through the retention form to the second cam. This trigger wire may include a bias mechanism, particularly when used in an asymetric type camming device.

These and related objects of the present invention are achieved by use of a spring loaded camming device with movably-anchored trigger as described herein.

The attainment of the foregoing and related advantages and features of the invention should be more readily apparent to those skilled in the art, after review of the following more detailed description of the invention taken together with the drawings.

DETAILED DESCRIPTION

Figure 1:
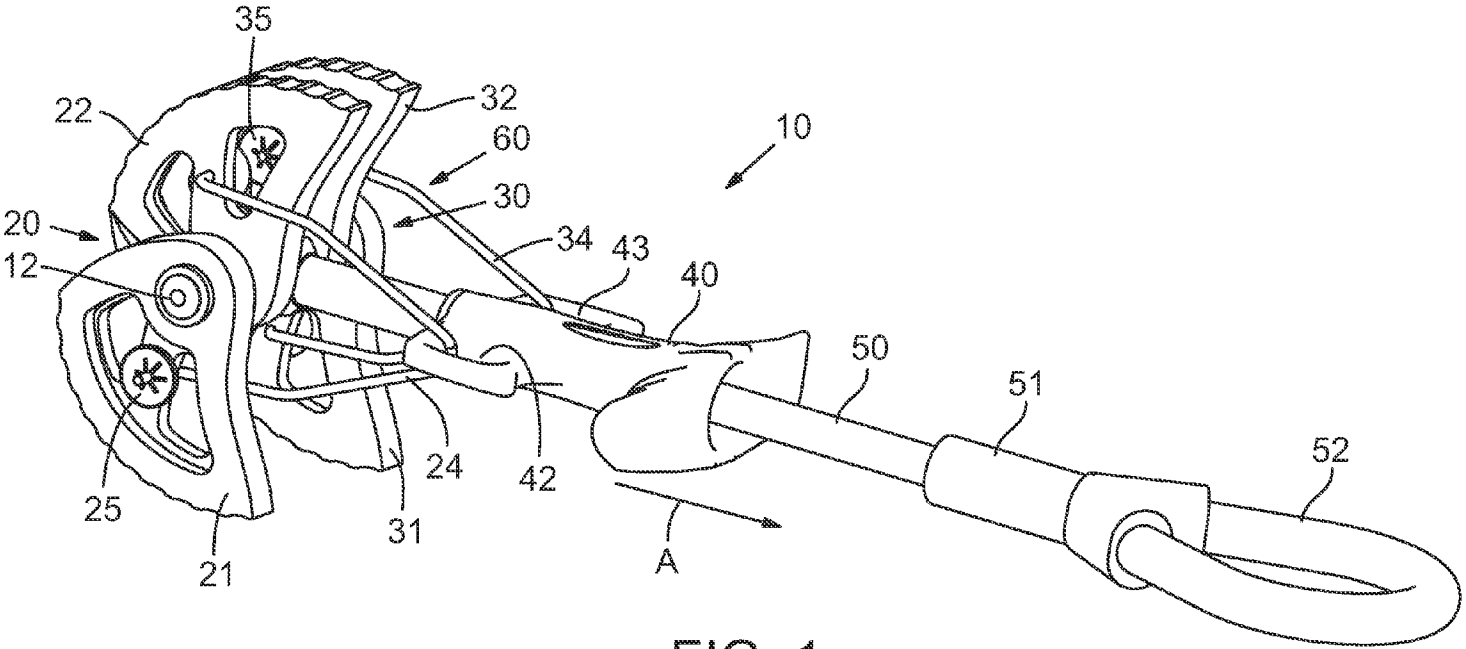
FIGS. 1-3 are a perspective and two elevation views of a spring loaded camming device in accordance with the present invention.
Figure 2:
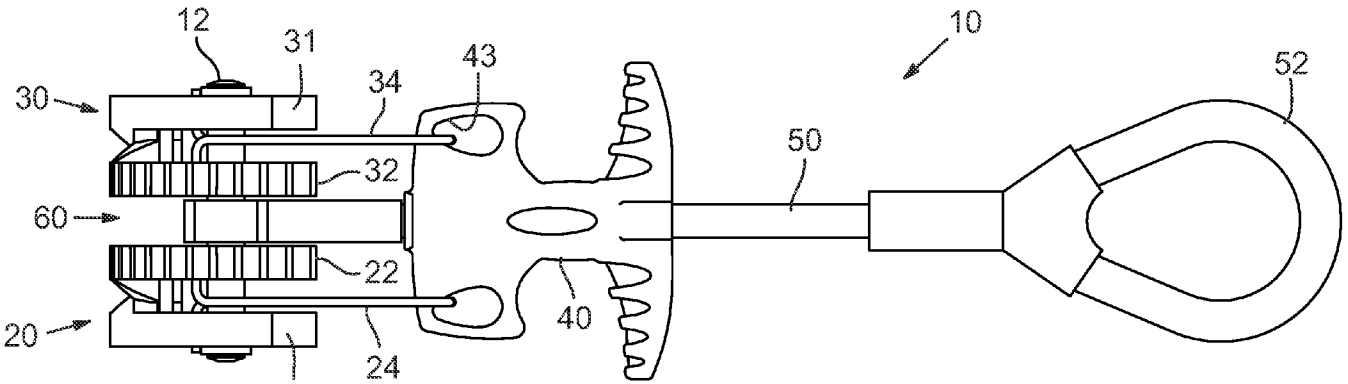
Figure 3:
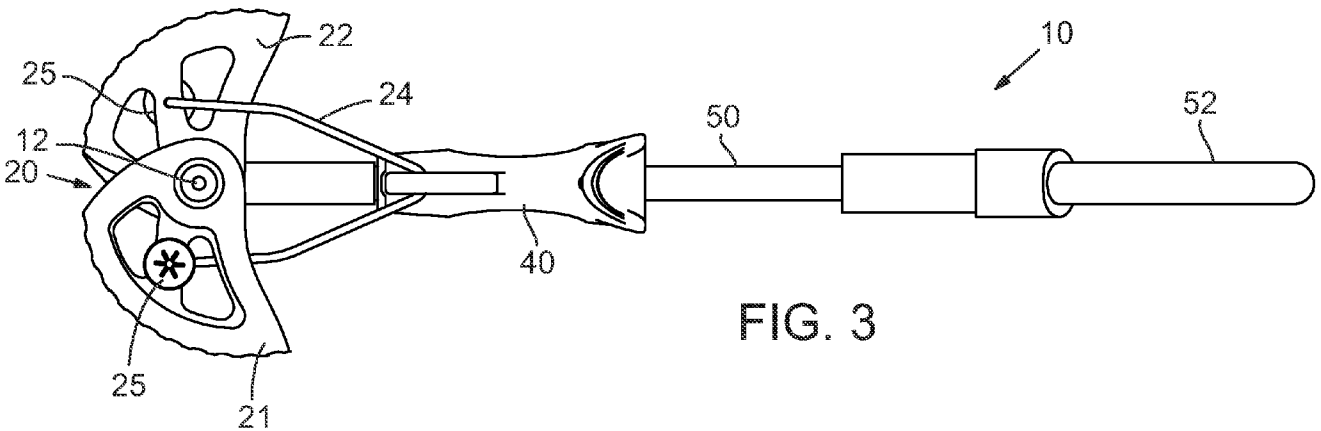

Referring to FIGS. 1-3, a perspective and two elevation views of a spring loaded camming device 10 in accordance with the present invention are shown. Device 10 may include four cams 21-22, 31-32, an axle 12, trigger wires 24, 34, trigger wire anchors 25, 35, a trigger handle 40, a stem 50, clip-in loop 52, and a head 60 that holds the axle and is mounted at the end of the stem.

The cam pairs 20, 30 may be provided on opposite sides of stem 50 and are configured for substantially independent movement (as is the case in conventional spring loaded camming devices). A single trigger wire 24, 34 is provided for each cam pair. This wire is coupled to one cam, passes through an opening 42, 43 in the trigger handle 40 and secures to the other cam in the pair. The trigger wire ends may be secured with anchor as shown or other suitable means. Various methods of securing a wire to a cam are known in the art.

It is shown in FIGS. 1-6 (and FIGS. 7,8A-8C for wire 124) that trigger wires 24,34 may have a lower or base region that passes through a trigger opening 42,43 and extends in one direction to a first cam and in another direction to the second of the cam pair.

Each cam pair 20, 30 has an associated torsion spring, obscured from view (yet known in the art) that biases the cams to an extended or "open" position. The open position is shown in FIG. 1.

Figure 4:
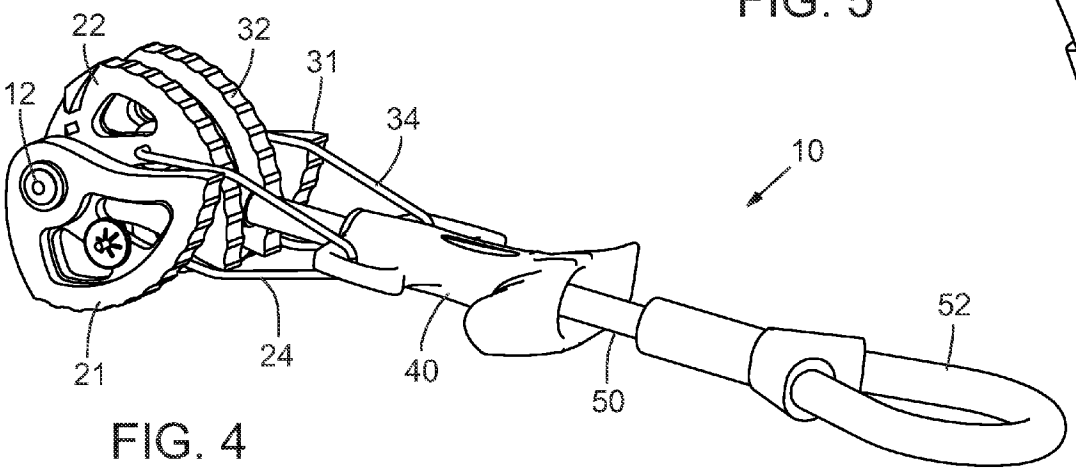
FIG. 4 is a perspective view of the camming device of FIG. 1 with the cams in a retracted position.

Handle 40 is configured with stem 50 so that it may readily slide along the stem. In use, a climber may grasp device 10 at the base 51 of the stem and insert their thumb in loop 52. The index and middle finger may then be used to pull down on trigger 40, in the direction of arrow A. This movement causes the trigger wires 24, 34 to pull on the cams 21-22, 31-32 rotating them around axle 12 towards a "closed" position, opposing the force of the bias springs. Camming device 10 in the closed position or with the cams substantially retracted is shown in FIG. 4.

Trigger wires 24, 34 (and trigger wires 124, 134 below) are preferably singular devices, i.e, made of one single piece of material, in contrast to the multi-part linkage assembly used in the prior art. Nonetheless, a multi-link assembly of one kind or another may be used without departing from the present invention. Trigger wires 24, 34 preferably pass through opening 42, 43 in handle 40, respectively. While the structure of the handle is such as to engage wires 24, 34, the wires are not fixedly mounted to the handle, rather they may move freely through openings 42, 43.

The singular or reduce components trigger linkage of the present invention achieves several benefits. They include, but are not limited to the following:

1. reduction in manufacturing cost;
2. reduction in part count;
3. reduction in labor and precision human operations required at assembly, which in turn achieves reduced opportunity for variation and mistakes in the manufacturing process; and
4. eliminates trigger cables and shortens the length of exposed trigger wires, reducing or eliminating entanglement with other gear;
5. trigger wires are easily replaced by the consumer, should they become damaged;
6. in manufacturing, the trigger wire linkage of the present invention may be installed after the cams are attached to the axle, which further simplifies the assembly process; and
7. device 10 appears to have a stronger and more robust design, as it is eliminates the more fragile cables from the trigger mechanism.

Figure 5:
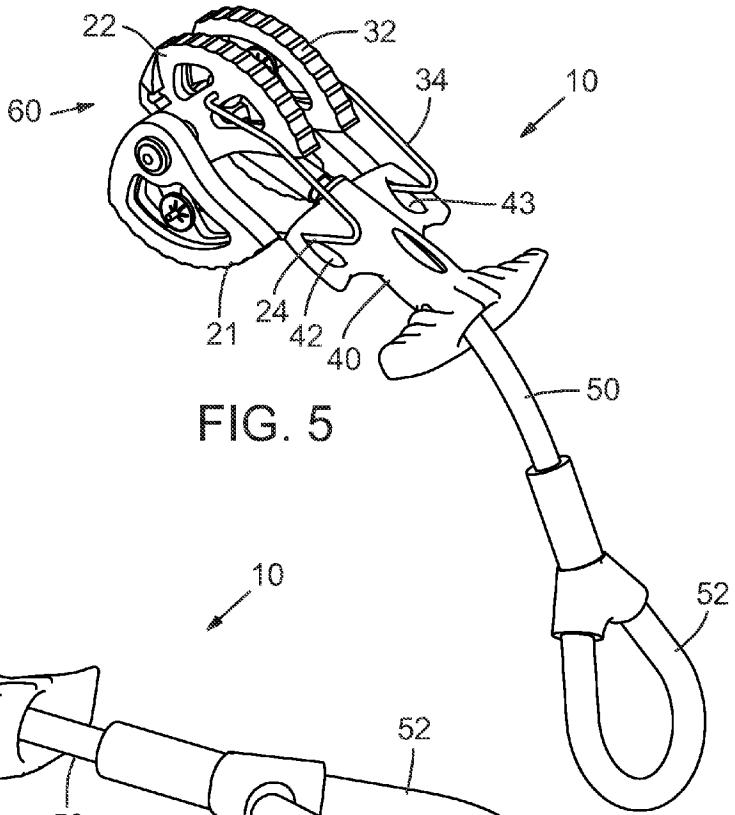
FIGS. 5-6 are two perspective views of the camming device of FIG. 1 with the stem moving front to back and side to side, respectively.
Figure 6:
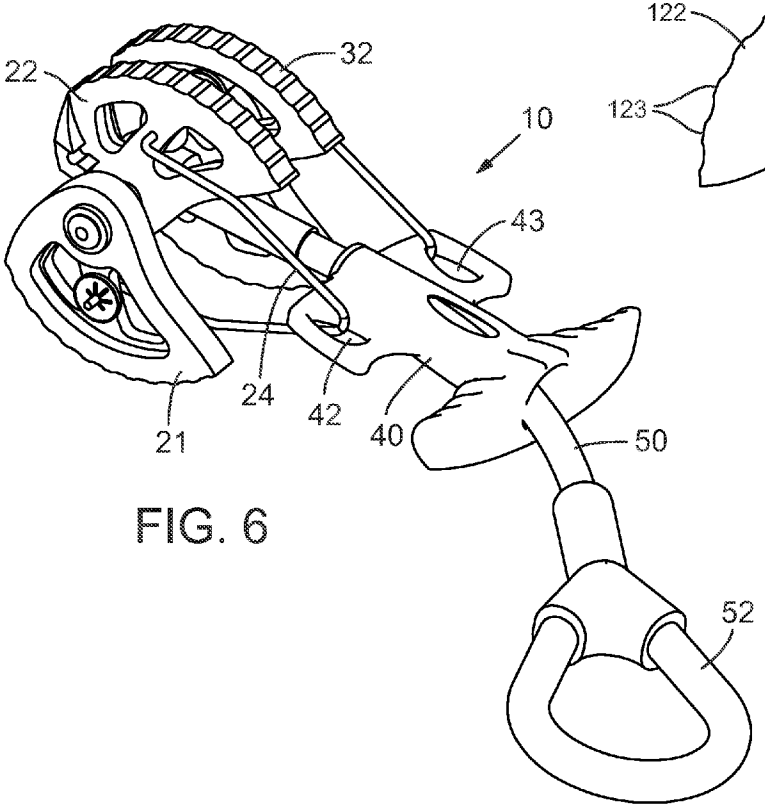

Referring to FIGS. 5-6, two perspective views of camming device 10 with the stem moving front to back and side to side, respectively, are shown.

Camming device 10, and other camming devices herein, are similar to prior art camming devices in that there is compliance in their design such that flexing the stem does not significantly impart forces to the can head which might reposition or dislodge the cams. In contrast, however, to the compliant trigger cables of the prior art that are fixedly coupled to the trigger handle, in at least one embodiment of the present invention, the trigger wires are not physically coupled to trigger 40. Trigger wires 24,34 merely pass through holes 42,43, respectively. As stem 50 flexes, from side to side or front to back (or in between), the trigger handle has the freedom to ride up/down the stem and the individual trigger wires 24,34 have the freedom to move or slide relative to trigger handle 40.

As shown in FIG. 5, when stem 50 is flexed down or up (perpendicular from side to side), trigger handle 40 passively slides up stem 50 towards cam head 60. This allows trigger handle 40 to slide along trigger wires 24, 34 in a way that does not impart forces to the cams. In FIG. 5, the stem has been pulled downward. The trigger handle 40 slides up the stem to accommodate this new stem position. No extraneous loads are imparted to trigger wires 24, 34 or the cam head due to the stem's deflection.

As shown in FIG. 6, side flexing of the stem causes trigger handle 40 to twist relative to the cam head. The elongated hole 42 in trigger handle 40 provides trigger wire 24 with the freedom to move within (and through) the hole. A similar yet opposite effect occurs with wire 34 and hole 43 when the stem swings in the direction opposite of that shown in FIG. 6.

Figure 7:
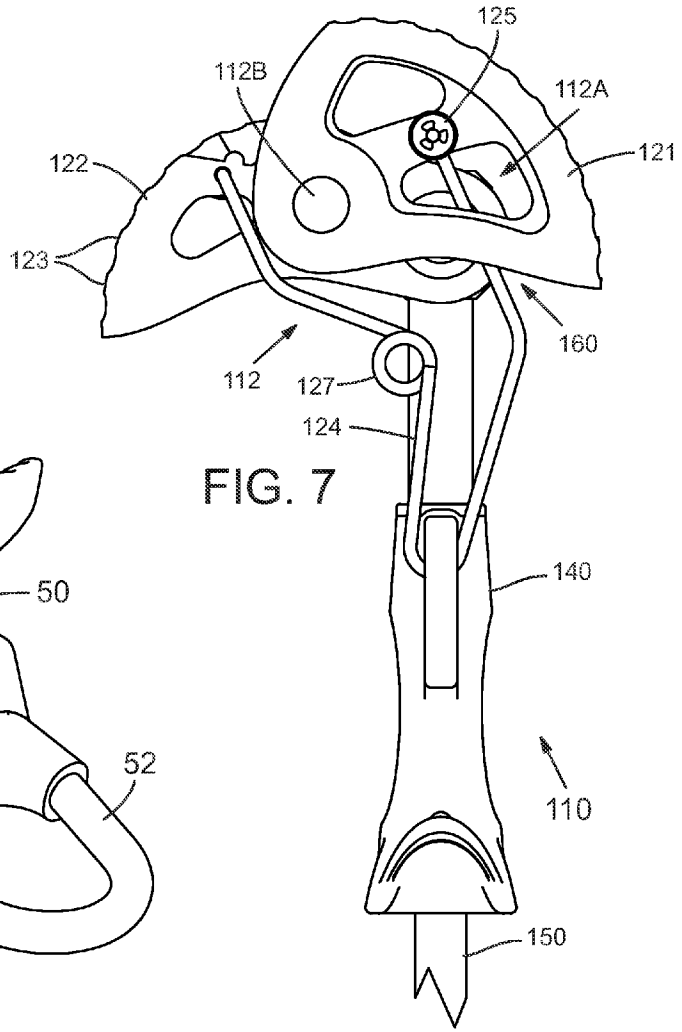
FIGS. 7 and 8A-8C are side views of another embodiment of a camming device in accordance with the present invention.

Referring to FIG. 7, a side view of another embodiment of a camming device 110 in accordance with the present invention is shown. Camming device 110 is an asymmetric type camming device. It includes many of the same components as device 10 of FIG. 1, for example: an axle arrangement 112, outer and inner cams 121,122 (and 131,132 obscured from view), trigger wire 124 (and 134 obscured from view), trigger wire anchors 125, a handle 140, a stem 150 and a head 160. As shown in FIGS. 7 and 8A-8C, however, device 110 has a conventional asymmetric axle arrangement with an axle 112A at head 160 for inner cam 122 and an axle 112B on inner cam 122 for outer cam 121. Axle 112B is offset from the stem 150. Also, the shape of the inner and outer cams may be different, as shown.

Device 110 includes a trigger wire and trigger handle arrangement similar to that of device 10 of FIG. 1 such that trigger wires 124,134 move relative to the trigger handle and the trigger handle moves relative to the stem, in a manner similar to that discussed above with reference to FIGS. 1-6 and device 10. Trigger wires 124,134 may include an additional feature which is a torsion spring 127 or like element fashioned in the trigger wire in the portion between the handle opening and the inner cam (the cam that extends from axle 112A), cam 122 in FIG. 7. Note that while torsion spring 127 is preferably formed with trigger wires 124, a biasing element serving the purpose of spring 127 may be provided in place of spring 127 (and need not be formed integrally with the trigger wire) without departing from the present invention.

The torsion spring 127 is included to address the issue of "tipping out" discussed above and functions to resist rotation of the head. If the stem of this embodiment is pushed further into a crack, the cams slide substantially even along the crack face. The torsion spring resists a tipping out situation in which the inner cam rotates or is compressed towards the stem such that its "teeth" 123 fail to adequately contact the crack face. If normal rope motion causes "walking," the inner and outer cams slide substantially evenly in a manner more like conventional symmetric cams.

As mentioned previously, it is important that a trigger system allow the stem to flex without allowing movement of the camming device to an unsafe placement orientation. Therefore, significant compliance is required between the stem orientation and the cam head. In device 110, the trigger wire configuration and the corresponding arrangement of the trigger handle allow the stem to flex in any direction without affecting the placement in the crack (and while resisting "tipping out").

When stem 150 moves side to side, the trigger wire and trigger handle operate in a manner similar to that discussed with reference to FIG. 6 and device 10. When stem 150 moves front to back (referred to as up and down with reference to FIG. 5), the trigger wire and trigger handle operate as described with reference to FIGS. 8A-8C.

Figures 8A, 8B, 8C:
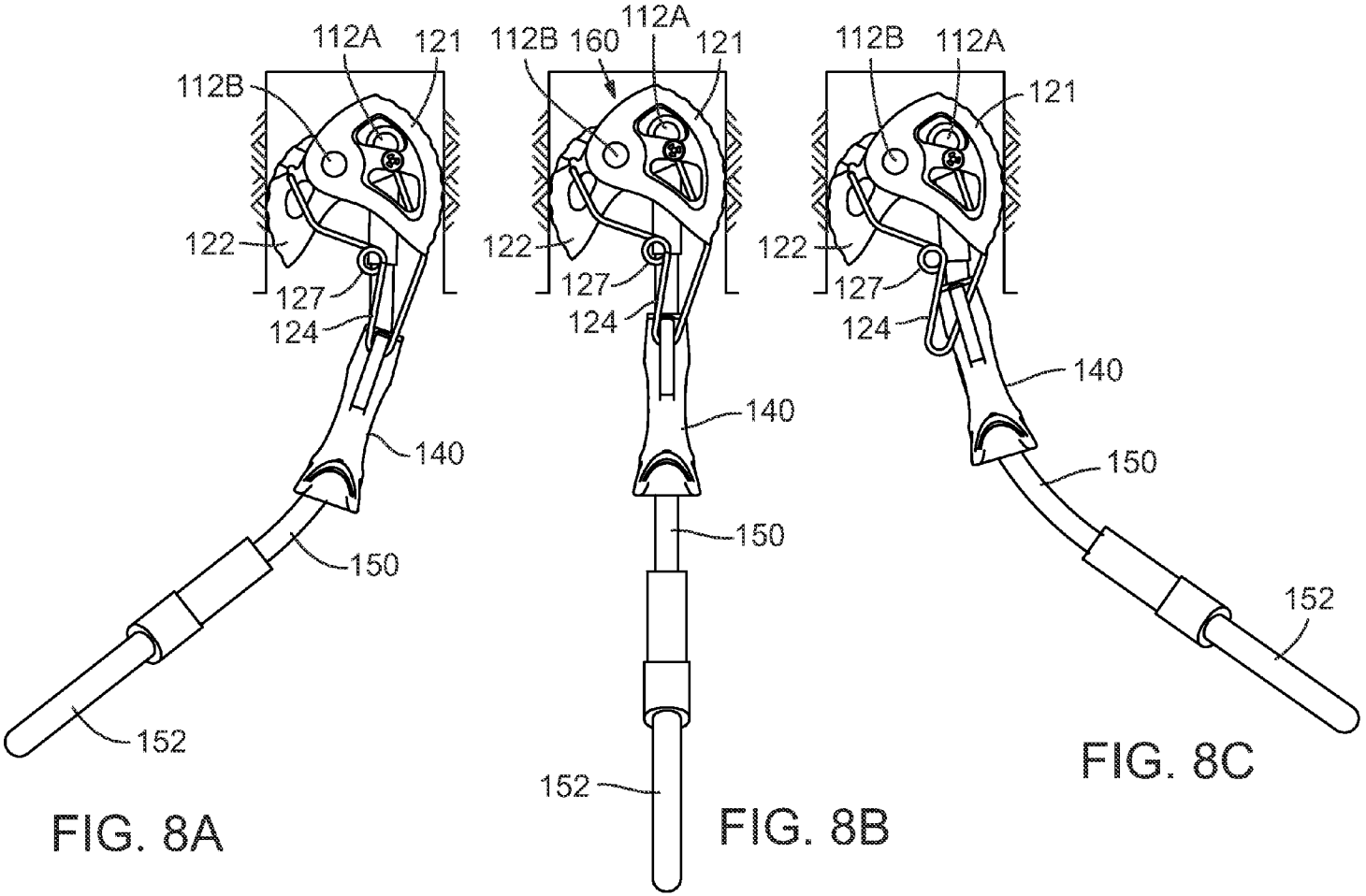

FIG. 8A illustrates a situation in which stem 150 has swung or moved towards the inner cams (the stem cable is flexible). In this case, trigger handle 140 has begun to bear into torsion spring 127 formed in the trigger wire. This slight moment resistance on the inner cams does not negatively impact the stability of the placement. No tension is created in the portion of the trigger wires connecting to the outer cams. Therefore, flexing the stem in this way does not lever-out the outer cams.

FIG. 8B illustrates the stem descending substantially straight down. Operation in this stem position is similar to that discussed above with reference to FIG. 3 and device 10.

FIG. 8C illustrates a situation in which stem 150 has swung or moved away from the inner cams. In this case, trigger handle 140 slides up the trigger wires 124 (and 134, not shown) which, in turn, pushes trigger handle 140 up the stem. As the trigger handle readily slides up the stem, and the stem flexes rather freely, the stem does not significantly impart loads to the cam head. The trigger handle moves up the stem in a manner that does not create tension on the portion of the trigger wires between the handle and inner cams. Therefore, flexing the stem towards the outer cams does not lever-out the inner cams.

It should be recognized that materials for making climbing devices are known in the art and other materials may be developed in the future. These materials may be used in the present invention without departing from its spirit or scope. The trigger wires 24,34,124,134 are preferably made of metal and preferably with some degree of shape retention or memory. In one embodiment, the trigger wires are resilient (return to their initial shape). They are preferably more rigid than the flexible cables of the prior art, yet flexible enough to bend slightly (to avoid damage) and resilient enough to return to their initial shape in the absence of the bending force. The trigger wires and other components herein may be made of any suitable materials that meet the criteria and/or function discussed above and exhibit the durability, environmental exposure, weight and other parameters desired in a climbing tool. The trigger wires may be made of a strong and/or durable plastic, among other materials.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A spring loaded camming device, comprising:

a first cam rotatably coupled to an axle;

a second cam rotatably coupled to an axle and having a range of rotation that is oriented differently from that of the first cam;

a stem that is mechanically coupled to the first and second cams and extends therefrom;

a trigger handle configured for slidable movement along the stem and defining a trigger wire passing retention form; and a continuous trigger wire coupled from the first cam through the retention form to the second cam and configured with the stem and trigger handle such that as the stem flexes relative to the first and second cams, in at least one direction, and the trigger handle slides along the stem in response to this flexure, a base region of the trigger wire moves through the retention form in the trigger handle such that the trigger handle moves substantially without moving the trigger wire.

2. The device of claim 1, wherein the trigger wire is flexible yet possesses shape memory, regaining its initial shape in the absence of a distorting force.

3. The device of claim 2, wherein the trigger wire is a substantially single continuous wire extending from the first cam to the second cam.

4. The device of claim 1, wherein the first and second cams are substantially symmetrical and the base region includes two generally-opposing angled members; and further wherein as the stem swings through a plane perpendicular to the axle, the trigger handle slides up one or the other of the two angled members.

5. The device of claim 4, wherein the trigger wire is flexible, possesses shape memory and has a substantially symmetric shape.

6. The device of claim 1, wherein the retention form defines a passthrough opening in the trigger handle, the trigger wire passing through the passthrough opening and being non-fixedly coupled to the trigger handle.

7. The device of claim 1, further comprising a third cam, a fourth cam, a second trigger wire retention form and a second trigger wire, the second trigger wire being coupled from the third cam through the second retention form to the fourth cam.

8. The device of claim 1, wherein the first and second cams are arranged substantially asymmetrically.

9. The device of claim 8, wherein the trigger wire includes a first portion extending from the base region to the first cam and a second portion extending from the base region to the second cam;

wherein the first portion includes a bias member that renders the first portion more pliable than the second portion.

10. The device of claim 9, wherein the bias member is a spring member.

11. The device of claim 9, wherein the bias member is configured such that when the stem swings in a plane perpendicular to the axle and towards the first cam, the bias member absorbs force from the stem and biases against movement of the stem towards the first cam.

12. The device of claim 1, wherein the continuous trigger wire is a singular trigger wire extending substantially from the first cam to the second cam.

13. A spring loaded camming device, comprising:

an axle;

a first cam;

a second cam;

a flexible stem;

a trigger handle configured for movement relative to the stem and having a trigger wire retention form; and a trigger wire that extends substantially as a single piece from the first cam through the retention form to the second cam;

wherein the trigger wire is flexible yet possesses shape memory, regaining its initial shape in the absence of a distorting force.

14. The device of claim 13, wherein the trigger wire is configured with the trigger handle and retention form so that when the stem flexes relative to a cam and the trigger handle slides along the stem in response to this flexure, the trigger wire moves through the trigger handle at the retention form.

15. The device of claim 13, wherein the first and second cams are substantially symmetrical; and wherein the trigger wire has a base region with two angled members and as the stem swings through a plane perpendicular to the axle the trigger handle slides up one or the other of the two angled members.

16. The device of claim 13, wherein the retention form defines a passthrough opening in the trigger handle through which the trigger wire moves.

17. The device of claim 13, wherein the trigger wire includes a base region, a first portion extending from the base region to the first cam and a second portion extending from the base region to the second cam;

wherein each of the first portion and second portion include a near-base section that is near said base region and a far-base section that is further from said base region, and wherein the angle of the near-base section to the far-base section is more acute in the first portion than in the second portion.

18. The device of claim 13, wherein the trigger wire includes a first portion extending from a base region thereof to the first cam and a second portion extending from the base region to the second cam;

wherein the axle includes a first cam axle about which the first cam moves and a second cam axle about with the second cam moves, the first and second cam axles being non-coaxial;

wherein the stem terminates at a head in which the first cam is mounted for movement; and wherein the first portion of the trigger wire is more pliable when the stem is moved toward the first cam than the second portion is when the stem is moved toward the second cam.

19. The device of claim 8, wherein the trigger wire includes a first portion extending from the base region to the first cam and a second portion extending from the base region to the second cam;

wherein each of the first portion and second portion include a near-base section that is near said base region and a far-base section that is further from said base region, and wherein the angle of best fit lines for the near-base section to the far-base section is more acute in the first portion than in the second portion.

20. The device of claim 8, wherein the trigger wire includes a first portion extending from the base region to the first cam and a second portion extending from the base region to the second cam;

wherein the axle includes a first cam axle about which the first cam moves and a second cam axle about with the second cam moves, the first and second cam axles are arranged non-coaxially;

wherein the stem terminates at a head in which the first cam is mounted for movement; and wherein the first portion of the trigger wire is more pliable when the stem is moved toward the first cam than the second portion is when the stem is moved toward the second cam.

21. A spring loaded camming device, comprising:

a axle;

a first cam;

a second cam;

a flexible stem;

a trigger handle configured for movement relative to the stem and having a trigger wire retention form;

a trigger wire that is coupled to and extends substantially singularly and continuously between the first and second cams, the trigger wire being retained by the retention form;

wherein the trigger wire and the trigger handle are configured as at least one of the following:

the trigger wire includes a bias member that absorbs force transferred from the stem to the trigger handle and then to the trigger wire, and the trigger wire moves relative to the trigger handle so that a force transferred from the stem to the trigger handle is not substantially transferred to the trigger wire.

22. The device of claim 21, wherein the trigger wire is flexible yet resilient, regaining an initial shape in the absence of a distorting force.

* * * * *